US010290920B2

(12) United States Patent
Boers et al.

(10) Patent No.: US 10,290,920 B2
(45) Date of Patent: May 14, 2019

(54) LARGE SCALE INTEGRATION AND CONTROL OF ANTENNAS WITH MASTER CHIP AND FRONT END CHIPS ON A SINGLE ANTENNA PANEL

(71) Applicant: Movandi Corporation, Newport Beach, CA (US)

(72) Inventors: Michael Boers, South Turramurra (AU); Farid Shirinfar, Granada Hills, CA (US); Sam Gharavi, Irvine, CA (US); Seunghwan Yoon, Irvine, CA (US); Alfred Grau Besoli, Irvine, CA (US); Maryam Rofougaran, Rancho Palos Verdes, CA (US); Ahmadreza Rofougaran, Newport Coast, CA (US)

(73) Assignee: Movandi Corporation, Newport Beach, CA (US)

( * ) Notice: Subject to any disclaimer, the term of this patent is extended or adjusted under 35 U.S.C. 154(b) by 308 days.

(21) Appl. No.: 15/226,785

(22) Filed: Aug. 2, 2016

(65) Prior Publication Data

US 2018/0040946 A1 Feb. 8, 2018

(51) Int. Cl.

| | |
|---|---|
| ***H01Q 1/22*** | (2006.01) |
| ***H01Q 21/24*** | (2006.01) |
| ***H01Q 21/06*** | (2006.01) |
| ***H01Q 3/38*** | (2006.01) |
| ***H01Q 21/00*** | (2006.01) |

(52) U.S. Cl.

CPC ..... *H01Q 1/2275* (2013.01); *H01Q 3/38* (2013.01); *H01Q 21/0093* (2013.01); *H01Q 21/065* (2013.01); *H01Q 21/245* (2013.01)

(58) Field of Classification Search

None

See application file for complete search history.

(56) References Cited

U.S. PATENT DOCUMENTS

| | | | | |
|---|---|---|---|---|
| 2010/0296552 | A1* | 11/2010 | Budampati | H04B 7/0857 375/148 |
| 2012/0164964 | A1* | 6/2012 | Kwon | H04B 7/086 455/226.1 |
| 2015/0171914 | A1* | 6/2015 | Desclos | H04B 1/0057 455/77 |
| 2016/0323080 | A1* | 11/2016 | Khlat | H04B 7/0413 |
| 2016/0352368 | A1* | 12/2016 | Khlat | H04B 1/1027 |
| 2017/0187109 | A1* | 6/2017 | Wang | H01Q 3/267 |
| 2018/0198454 | A1* | 7/2018 | Sjoland | H03L 7/081 |

* cited by examiner

*Primary Examiner* — Mohammed Rachedine

(74) *Attorney, Agent, or Firm* — Farjami & Farjami LLP

(57) ABSTRACT

A wireless receiver includes an antenna panel divided into a plurality of segments, each segment having a group of antennas, each segment having a set of radio frequency (RF) front end chips. Each RF front end chip is coupled to some antennas in the group of antennas. A master chip is configured to drive in parallel a plurality of control buses. Each control bus is coupled to a respective one of the plurality of segments, where each RF front end chip in the set of RF front end chips is serially coupled to another RF front end chip in the set of RF front end chips. Each control bus carries phase shift signals and amplitude control signals from the master chip to a respective set of RF front end chips in each segment. The master chip and the plurality of segments in the antenna panel are integrated on a single printed circuit board.

22 Claims, 4 Drawing Sheets

LARGE SCALE INTEGRATION AND CONTROL OF ANTENNAS WITH MASTER CHIP AND FRONT END CHIPS ON A SINGLE ANTENNA PANEL

BACKGROUND

Wireless communications, such as satellite communications, utilize electromagnetic signals to transfer information between two or more points. In conventional wireless receivers, for example satellite dish receivers, mechanical motors are combined with electrical components to adjust the position of the receiver or its antennas in azimuth and/or elevation planes to receive the desired electromagnetic signals.

An antenna panel integrated on a single printed circuit board ("PCB") employing thousands of antennas is a novel approach to receive desired electromagnetic signals without using any mechanical adjustments. However, such an antenna panel presents significant challenges in routing electrical signals. For example, a master chip may need to deliver phase shift information (i.e. phase shift signals) to hundreds of RF front end chips that in turn control thousands of antennas. The delivery of phase shift information can require, for example, a ten-bit bus. Thus, just to deliver phase shift information, there need be thousands of traces on a PCB. In addition, other control and data buses need be routed from and to the master chip from each RF front end chip, and also each of the thousands of antennas need be coupled to at least one of hundreds of RF front end chips.

Thus, there is need in the art to overcome the high implementation cost and complexity in using antenna panels with thousands of antennas integrated on a single PCB along with hundreds of RF front end chips and a master chip integrated on the same PCB.

SUMMARY

The present disclosure is directed to large scale integration and control of antennas with master chip and front end chips on a single antenna panel, substantially as shown in and/or described in connection with at least one of the figures, and as set forth in the claims.

DETAILED DESCRIPTION

Figure 1A:
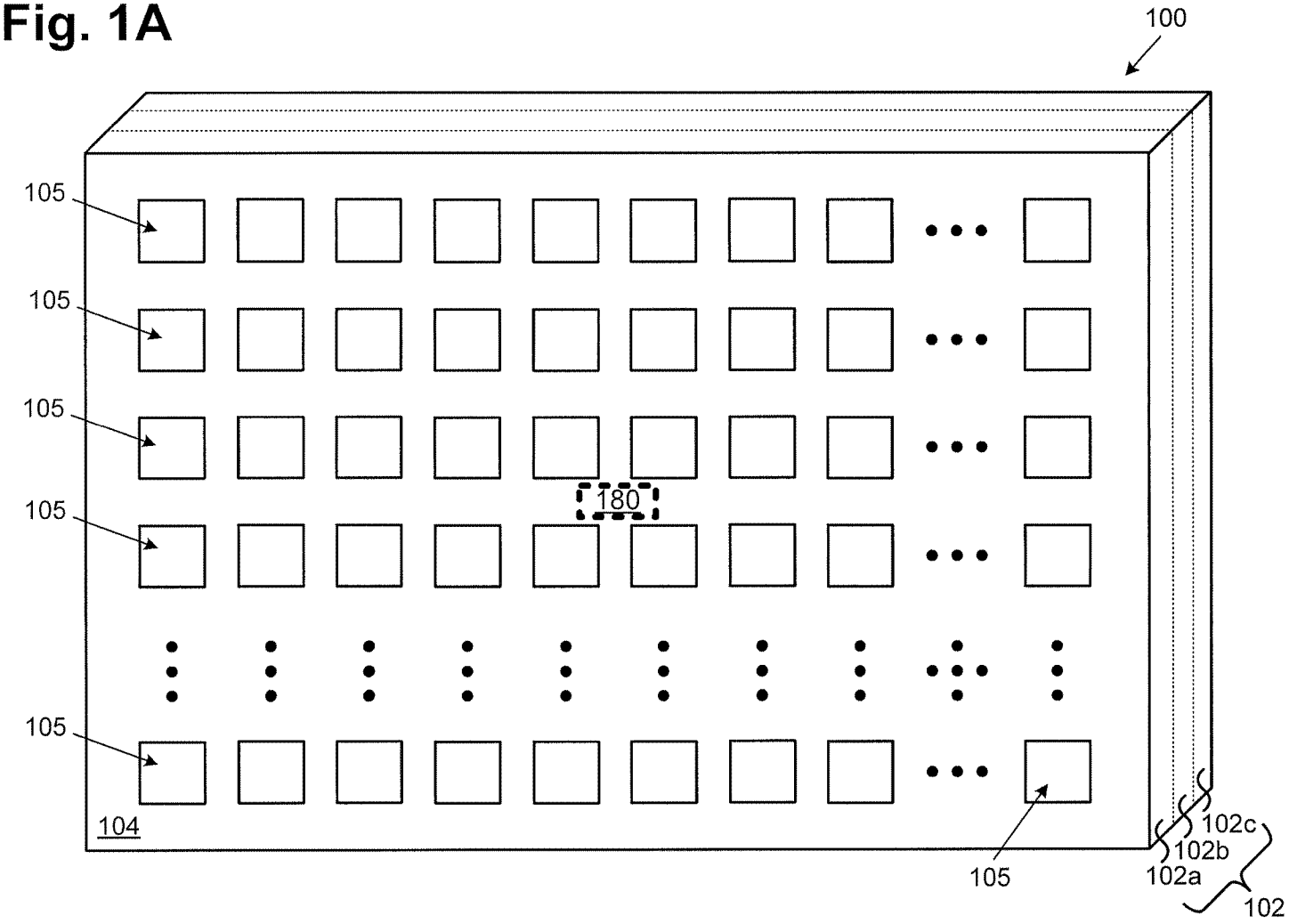
FIG. 1A illustrates a perspective view of a portion of an exemplary wireless receiver according to one implementation of the present application.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

Referring to FIG. 1A, FIG. 1A illustrates a perspective view of a portion of an exemplary wireless receiver according to one implementation of the present application. As illustrated in FIG. 1A, wireless receiver 100 includes substrate 102 having layers 102*a*, 102*b* and 102*c*, antenna panel 104 having front end units 105, and master chip 180. In the present implementation, substrate 102 may be a multi-layer printed circuit board (PCB) having layers 102*a*, 102*b* and 102*c*. Although only three layers are shown in FIG. 1A, in another implementation, substrate 102 may be a multi-layer PCB having greater or fewer than three layers.

As illustrated in FIG. 1A, antenna panel 104 having front end units 105 is formed on top layer 102*a* of substrate 102. In one implementation, substrate 102 of wireless receiver 100 may include 500 front end units 105, each having a radio frequency (RF) front end circuit connected to a plurality of antennas (not explicitly shown in FIG. 1A). In one implementation, wireless receiver 100 may include 2000 antennas on antenna panel 104, where each front end unit 105 includes four antennas connected to an RF front end circuit (not explicitly shown in FIG. 1A).

In the present implementation, master chip 180 may be formed in layer 102*c* of substrate 102, where master chip 180 may be connected to front end units 105 on top layer 102*a* using a plurality of control buses (not explicitly shown in FIG. 1A) routed through various layers of substrate 102. In the present implementation, master chip 180 is configured to provide phase shift and amplitude control signals from a digital core in master chip 180 to the RF front end chips in each of front end units 105 based on signals received from the antennas in each of front end units 105.

Figure 1B:
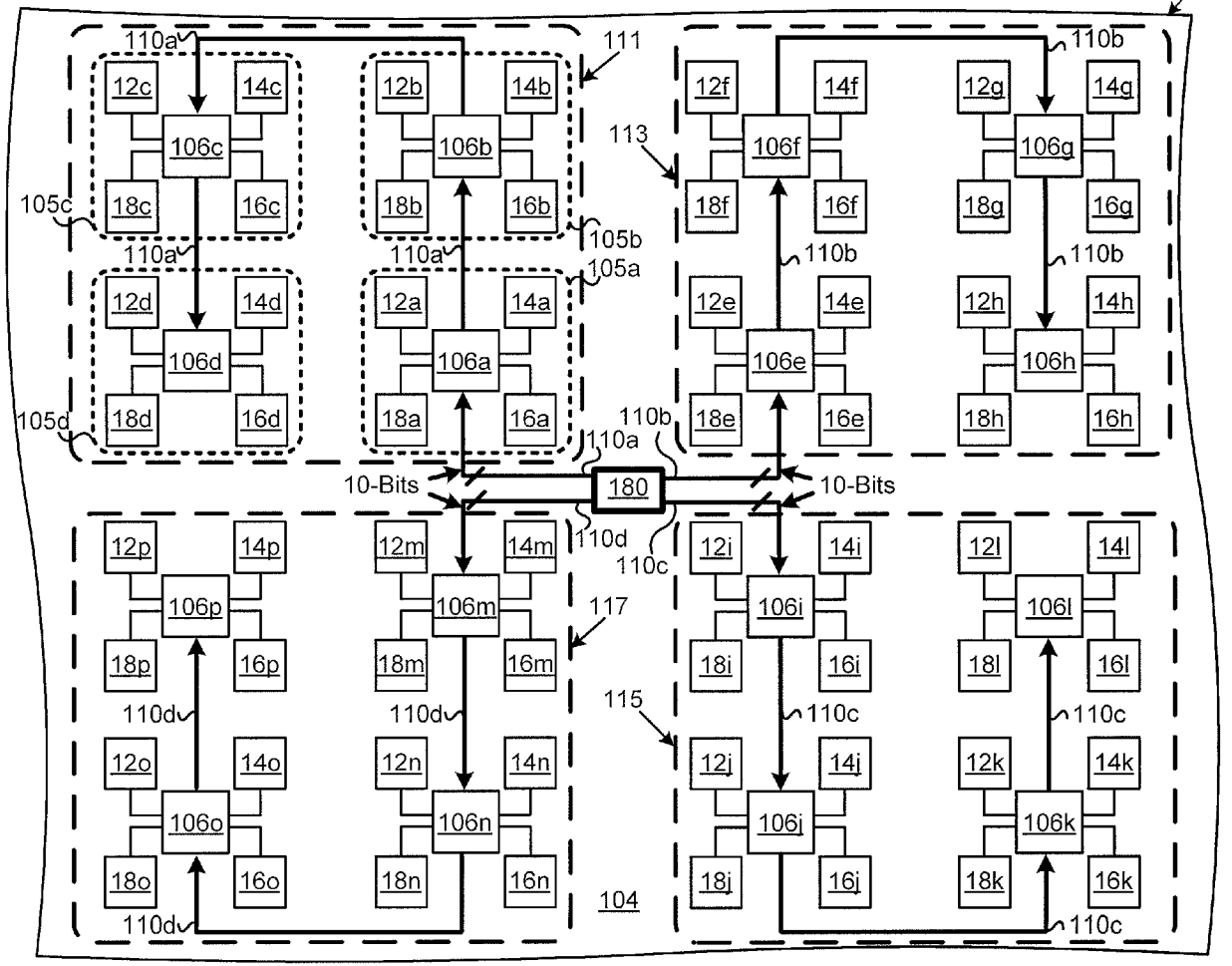
FIG. 1B illustrates a layout diagram of a portion of an exemplary wireless receiver according to one implementation of the present application.

Turning to FIG. 1B, FIG. 1B illustrates a layout diagram of a portion of an exemplary wireless receiver according to one implementation of the present application. For example, layout diagram 190 illustrates a layout of a simplified wireless receiver on a single printed circuit board (PCB) 192, where master chip 180 is configured to drive in parallel four control buses, e.g., control buses 110*a*, 110*b*, 110*c* and 110*d*, where each control bus is coupled to a respective segment, e.g., segments 111, 113, 115 and 117, of four front end units, e.g., front end units 105*a*, 105*b*, 105*c* and 105*d* in segment 111, where each segment includes a set of four RF front end chips, e.g., RF front end chips 106*a*, 106*b*, 106*c* and 106*d* in segment 111, and where each RF front end chip is coupled to four antennas, e.g., antennas 12*a*, 14*a*, 16*a* and 18*a* coupled to RF front end chip 106*a* in front end unit 105*a*.

As illustrated in FIG. 1B, antenna panel 104 includes antennas 12*a* through 12*p*, 14*a* through 14*p*, 16*a* through 16*p*, and 18*a* through 18*p*, collectively referred to as antennas 12-18. In one implementation, antennas 12-18 may be configured to receive and/or transmit signals from and/or to one or more commercial geostationary communication satellites or low earth orbit satellites.

In one implementation, for a wireless transmitter transmitting signals at 10 GHz (i.e., $\lambda$=30 mm), each antenna in antenna panel 104 in a wireless receiver needs an area of at least a quarter wavelength (e.g., $\lambda/4$=7.5 mm) by a quarter wavelength (e.g., $\lambda/4$=7.5 mm) to receive the transmitted signals. As illustrated in FIG. 1B, antennas 12-18 in antenna panel 104 may each have a square shape having dimensions of 7.5 mm by 7.5 mm, for example. In one implementation, each adjacent pair of antennas 12-18 may be separated by a distance of a multiple integer of the quarter wavelength (i.e., n*λ/4), such as 7.5 mm, 15 mm, 22.5 mm and etc. In general, the performance of the wireless receiver improves with the number of antennas 12-18 in antenna panel 104.

In the present implementation, antenna panel 104 is a flat panel array employing antennas 12-18, where antenna panel 104 is coupled to associated active circuits to form a beam for reception (or transmission). In one implementation, the beam is formed fully electronically by means of phase control devices associated with antennas 12-18. Thus, antenna panel 104 can provide fully electronic beamforming without the use of mechanical parts.

As illustrated in FIG. 1B, RF front end chips 106*a* through 106*p*, and antennas 12*a* through 12*p*, 14*a* through 14*p*, 16*a* through 16*p*, and 18*a* through 18*p*, are divided into respective segments 111, 113, 115 and 117. As further illustrated in FIG. 1B, segment 111 includes front end unit 105*a* having RF front end chip 106*a* coupled to antennas 12*a*, 14*a*, 16*a* and 18*a*, front end unit 105*b* having RF front end chip 106*b* coupled to antennas 12*b*, 14*b*, 16*b* and 18*b*, front end unit 105*c* having RF front end chip 106*c* coupled to antennas 12*c*, 14*c*, 16*c* and 18*c*, and front end unit 105*d* having RF front end chip 106*d* coupled to antennas 12*d*, 14*d*, 16*d* and 18*d*. Segment 113 includes similar front end units having RF front end chip 106*e* coupled to antennas 12*e*, 14*e*, 16*e* and 18*e*, RF front end chip 106*f* coupled to antennas 12*f*, 14*f*, 16*f* and 18*f*, RF front end chip 106*g* coupled to antennas 12*g*, 14*g*, 16*g* and 18*g*, and RF front end chip 106*h* coupled to antennas 12*h*, 14*h*, 16*h* and 18*h*. Segment 115 also includes similar front end units having RF front end chip 106*i* coupled to antennas 12*i*, 14*i*, 16*i* and 18*i*, RF front end chip 106*j* coupled to antennas 12*j*, 14*j*, 16*j* and 18*j*, RF front end chip 106*k* coupled to antennas 12*k*, 14*k*, 16*k* and 18*k*, and RF front end chip 106*l* coupled to antennas 12*l*, 14*l*, 16*l* and 18*l*. Segment 117 also includes similar front end units having RF front end chip 106*m* coupled to antennas 12*m*, 14*m*, 16*m* and 18*m*, RF front end chip 106*n* coupled to antennas 12*n*, 14*n*, 16*n* and 18*n*, RF front end chip 106*o* coupled to antennas 12*o*, 14*o*, 16*o* and 18*o*, and RF front end chip 106*p* coupled to antennas 12*p*, 14*p*, 16*p* and 18*p*.

As illustrated in FIG. 1B, master chip 108 is configured to drive in parallel control buses 110*a*, 110*b*, 110*c* and 110*d* coupled to segments 111, 113, 115 and 117, respectively. For example, control bus 110*a* is coupled to RF front end chips 106*a*, 106*b*, 106*c* and 106*d* in segment 111 to provide phase shift signals and amplitude control signals to the corresponding antennas coupled to each of RF front end chips 106*a*, 106*b*, 106*c* and 106*d*. Control buses 110*b*, 110*c* and 110*d* are configured to perform similar functions as control bus 110*a*. In the present implementation, master chip 180 and segments 111, 113, 115 and 117 having RF front end chips 106*a* through 106*p* and antennas 12-18 in antenna panel 104, are all integrated on a single printed circuit board.

It should be understood that layout diagram 190 in FIG. 1B is intended to show a simplified wireless receiver according to the present inventive concepts. In one implementation, master chip 180 may be configured to control a total of 2000 antennas disposed in ten segments. In this implementation, master chip 180 may be configured to drive in parallel ten control buses, where each control bus is coupled to a respective segment, where each segment has a set of 50 RF front end chips and a group of 200 antennas are in each segment; thus, each RF front end chip is coupled to four antennas.

Absent the present invention, such a wireless receiver would require 500 separate routing paths from the master chip to provide phase shift signals on a ten-bit control bus to all of the 50 RF front end chips, which could lead to high implementation cost and complexity. Alternatively, the wireless receiver could have a single serial link that is ten-bit wide to provide phase shift signals to each of the individual RF front end chips, which would require only ten separate routing paths (as opposed to 500 separate routing paths). However, using a single serial link would cause a long delay in providing the required phase shift information to each RF front end chip.

In contrast, by dividing the antenna panel into a plurality of segments, where each of the plurality of segments includes a group of antennas and a set of RF front end chips, where each RF front end chip is coupled to some antennas, and by driving in parallel a plurality of control buses each coupled to a respective one of the plurality of segments, where each control bus is coupled to a set of serially connected RF front end chips within each segment, implementations of the present application provide efficient routing of phase shift signals to multiple RF front end chips. Thus, various implementations of the present inventive concepts result in integration of thousands of antennas in a single antenna panel which in turn results in efficient phase shifting, improved refresh rate, and a fully electronic beamforming for receiving desired electromagnetic signals by the wireless receiver without use of any mechanical parts or mechanical adjustments.

Figure 2A:
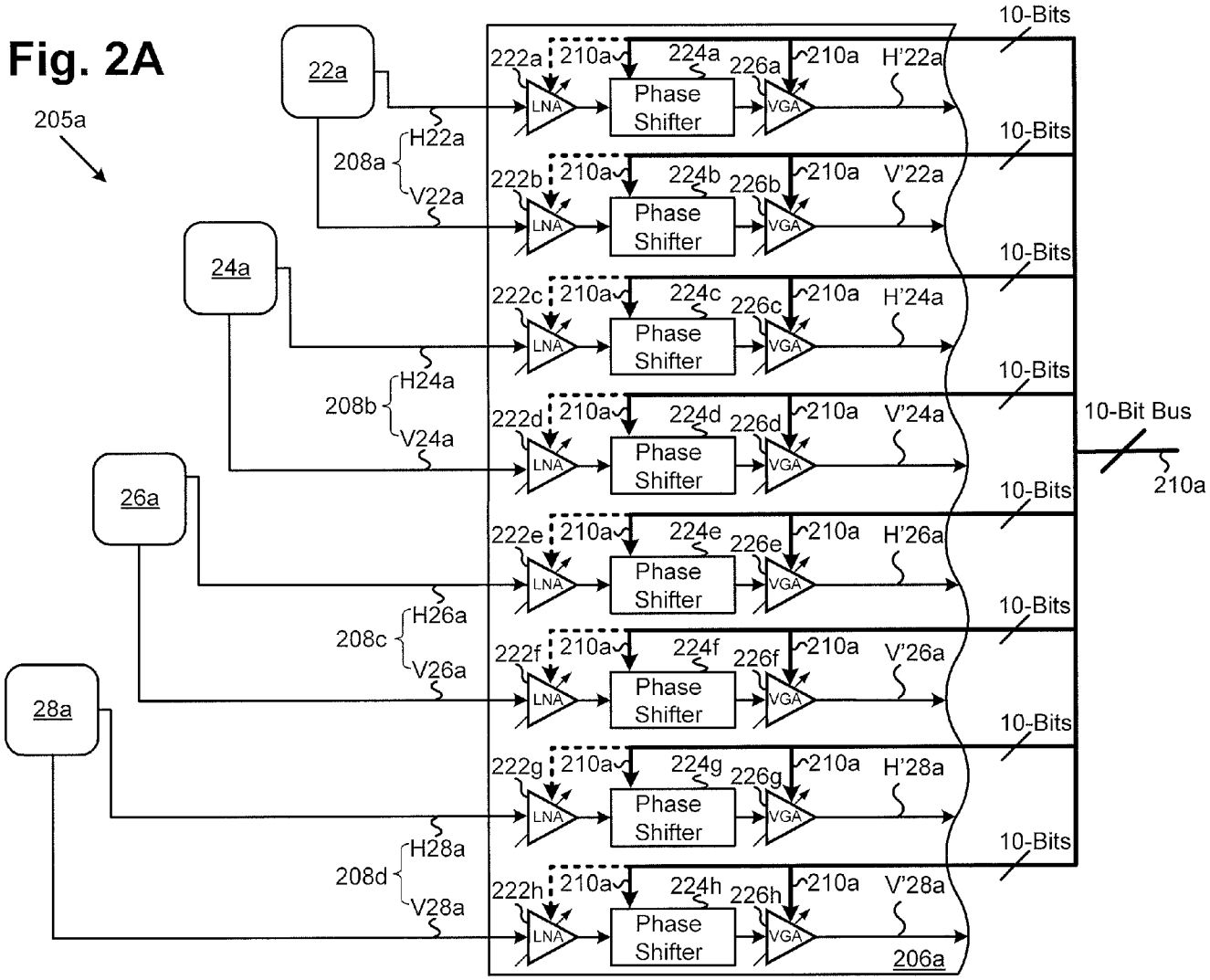
FIG. 2A illustrates a functional block diagram of a portion of an exemplary wireless receiver according to one implementation of the present application.

Referring to FIG. 2A, FIG. 2A illustrates a functional block diagram of a portion of an exemplary wireless receiver according to one implementation of the present application. In the present implementation, front end unit 205*a* may correspond to front end unit 105*a* in FIG. 1B of the present application. As illustrated in FIG. 2A, front end unit 205*a* includes antennas 22*a*, 24*a*, 26*a* and 28*a* coupled to RF front end chip 206*a*, where antennas 22*a*, 24*a*, 26*a* and 28*a* and RF front end chip 206*a* may correspond to antennas 12*a*, 14*a*, 16*a* and 18*a* and RF front end chip 106*a*, respectively, in FIG. 1B.

In the present implementation, antennas 22*a*, 24*a*, 26*a* and 28*a* may be configured to receive signals from one or more commercial geostationary communication satellites, for example, which typically employ circularly polarized or linearly polarized signals defined at the satellite with a horizontally-polarized (H) signal having its electric-field oriented parallel with the equatorial plane and a vertically-polarized (V) signal having its electric-field oriented perpendicular to the equatorial plane. As illustrated in FIG. 2A, each of antennas 22*a*, 24*a*, 26*a* and 28*a* is configured to provide an H output and a V output to RF front end chip 206*a*. For example, antenna 22*a* provides linearly polarized signal 208*a*, having horizontally-polarized signal H22*a* and vertically-polarized signal V22*a*, to RF front end chip 206*a*. Antenna 24*a* provides linearly polarized signal 208*b*, having horizontally-polarized signal H24*a* and vertically-polarized signal V24*a*, to RF front end chip 206*a*. Antenna 26*a* provides linearly polarized signal 208*c*, having horizontally-polarized signal H26*a* and vertically-polarized signal V26*a*, to RF front end chip 206*a*. Antenna 28*a* provides linearly polarized signal 208*d*, having horizontally-polarized signal H28*a* and vertically-polarized signal V28*a*, to RF front end chip 206*a*.

As illustrated in FIG. 2A, horizontally-polarized signal H22*a* from antenna 22*a* is provided to a receiving circuit having low noise amplifier (LNA) 222*a*, phase shifter 224*a* and variable gain amplifier (VGA) 226*a*, where LNA 222*a* is configured to generate an output to phase shifter 224*a*, and phase shifter 224*a* is configured to generate an output to VGA 226*a*. In addition, vertically-polarized signal V22*a* from antenna 22*a* is provided to a receiving circuit including low noise amplifier (LNA) 222*b*, phase shifter 224*b* and variable gain amplifier (VGA) 226*b*, where LNA 222*b* is configured to generate an output to phase shifter 224*b*, and phase shifter 224*b* is configured to generate an output to VGA 226*b*.

As shown in FIG. 2A, horizontally-polarized signal H24*a* from antenna 24*a* is provided to a receiving circuit having low noise amplifier (LNA) 222*c*, phase shifter 224*c* and variable gain amplifier (VGA) 226*c*, where LNA 222*c* is configured to generate an output to phase shifter 224*c*, and phase shifter 224*c* is configured to generate an output to VGA 226*c*. In addition, vertically-polarized signal V24*a* from antenna 24*a* is provided to a receiving circuit including low noise amplifier (LNA) 222*d*, phase shifter 224*d* and variable gain amplifier (VGA) 226*d*, where LNA 222*d* is configured to generate an output to phase shifter 224*d*, and phase shifter 224*d* is configured to generate an output to VGA 226*d*.

As illustrated in FIG. 2A, horizontally-polarized signal H26*a* from antenna 26*a* is provided to a receiving circuit having low noise amplifier (LNA) 222*e*, phase shifter 224*e* and variable gain amplifier (VGA) 226*e*, where LNA 222*e* is configured to generate an output to phase shifter 224*e*, and phase shifter 224*e* is configured to generate an output to VGA 226*e*. In addition, vertically-polarized signal V26*a* from antenna 26*a* is provided to a receiving circuit including low noise amplifier (LNA) 222*f*, phase shifter 224*f* and variable gain amplifier (VGA) 226*f*, where LNA 222*f* is configured to generate an output to phase shifter 224*f*, and phase shifter 224*f* is configured to generate an output to VGA 226*f*.

As further shown in FIG. 2A, horizontally-polarized signal H28*a* from antenna 28*a* is provided to a receiving circuit having low noise amplifier (LNA) 222*g*, phase shifter 224*g* and variable gain amplifier (VGA) 226*g*, where LNA 222*g* is configured to generate an output to phase shifter 224*g*, and phase shifter 224*g* is configured to generate an output to VGA 226*g*. In addition, vertically-polarized signal V28*a* from antenna 28*a* is provided to a receiving circuit including low noise amplifier (LNA) 222*h*, phase shifter 224*h* and variable gain amplifier (VGA) 226*h*, where LNA 222*h* is configured to generate an output to phase shifter 224*h*, and phase shifter 224*h* is configured to generate an output to VGA 226*h*.

As further illustrated in FIG. 2A, control bus 210*a*, which may correspond to control bus 110*a* in FIG. 1B, is provided to RF front end chip 206*a*, where control bus 210*a* is configured to provide phase shift signals to phase shifters 224*a*, 224*b*, 224*c*, 224*d*, 224*e*, 224*f*, 224*g*, and 224*h* in RF front end chip 206*a* to cause a phase shift in at least one of these phase shifters, and to provide amplitude control signals to VGAs 226*a*, 226*b*, 226*c*, 226*d*, 226*e*, 226*f*, 226*g* and 226*h*, and optionally to LNAs 222*a*, 222*b*, 222*c*, 222*d*, 222*e*, 222*f*, 222*g* and 222*h* in RF front end chip 206*a* to cause an amplitude change in at least one of the linearly polarized signals received from antennas 22*a*, 24*a*, 26*a* and 28*a*. It should be noted that control bus 210*a* is also provided to other front end units, such as front end units 105*b*, 105*c* and 105*d* in segment 111 of FIG. 1B. In one implementation, at least one of the phase shift signals carried by control bus 210*a* is configured to cause a phase shift in at least one linearly polarized signal, e.g., horizontally-polarized signals H22*a* through H28*a* and vertically-polarized signals V22*a* through V28*a*, received from a corresponding antenna, e.g., antennas 22*a*, 24*a*, 26*a* and 28*a*.

Figure 2B:
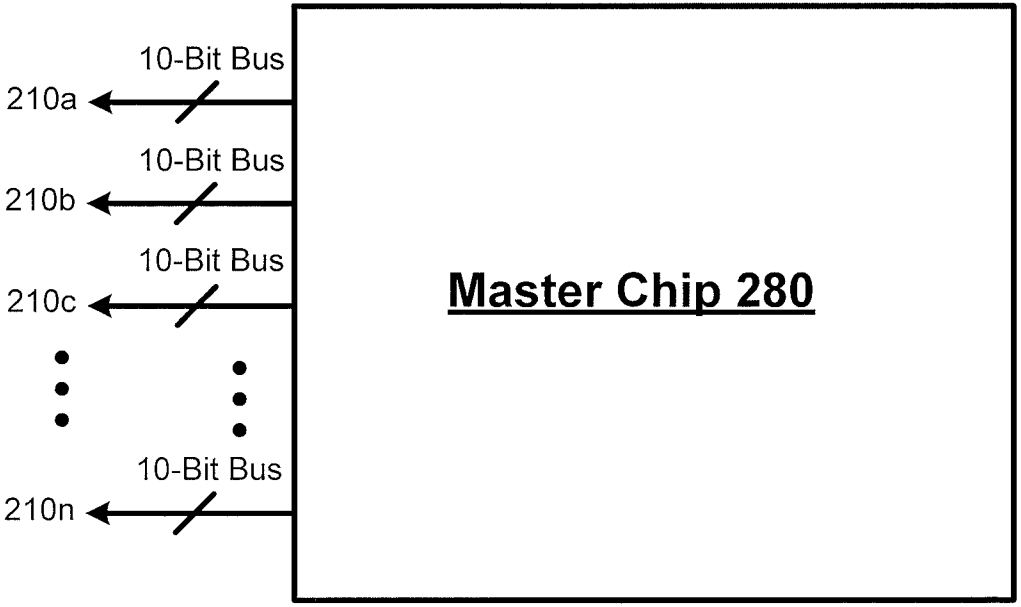
FIG. 2B illustrates a functional block diagram of a portion of an exemplary wireless receiver according to one implementation of the present application.

In one implementation, amplified and phase shifted horizontally-polarized signals H'22*a*, H'24*a*, H'26*a* and H'28*a* in front end unit 205*a*, and other amplified and phase shifted horizontally-polarized signal from the other front end units (e.g., front end units 105*b*, 105*c* and 105*d* as well as front end units in segments 113, 115 and 117 shown in FIG. 1B), may be provided to a summation block (not explicitly shown in FIG. 2A), that is configured to sum all of the powers of the amplified and phase shifted horizontally-polarized signals, and combine all of the phases of the amplified and phase shifted horizontally-polarized signals, to provide an H-combined output to a master chip such as master chip 280 in FIG. 2B. Similarly, amplified and phase shifted vertically-polarized signals V'22*a*, V'24*a*, V'26*a* and V'28*a* in front end unit 205*a*, and other amplified and phase shifted vertically-polarized signal from the other front end units (e.g., front end units 105*b*, 105*c* and 105*d* as well as front end units in segments 113, 115 and 117 shown in FIG. 1B), may be provided to a summation block (not explicitly shown in FIG. 2A), that is configured to sum all of the powers of the amplified and phase shifted horizontally-polarized signals, and combine all of the phases of the amplified and phase shifted horizontally-polarized signals, to provide a V-combined output to a master chip such as master chip 280 in FIG. 2B.

Referring to FIG. 2B, FIG. 2B illustrates a functional block diagram of a portion of an exemplary wireless receiver according to one implementation of the present application. In one implementation, master chip 280 is configured to receive an H-combined output and a V-combined output from all of the front end units in each segment of an antenna panel, and provide phase shift signals to phase shifters in the RF front end chips of each segment of the antenna panel through corresponding control buses, such as control buses 210*a*, 210*b*, 210*c* through 210*n*. In one implementation, master chip 280 is configured to drive in parallel control buses 210*a*, 210*b*, 210*c* . . . 210*n*, each being coupled to a respective segment of an antenna panel. With reference to FIG. 2A, control bus 210*a* is configured to provide phase shift signals to phase shifters 224*a*, 224*b*, 224*c*, 224*d*, 224*e*, 224*f*, 224*g* and 224*h* in RF front end chip 206*a* in FIG. 2A. In one implementation each control bus 210*a*, 210*b*, 210*c* . . . 210*n* is a ten-bit bus. In other implementations, each control bus 210*a*, 210*b*, 210*c* . . . 210*n* can be greater or fewer than ten bits.

In one implementation, master chip 280 may include an axial ratio and cross-polarization calibration block, a left-handed circularly polarized (LHCP)/right-handed circularly polarized (RHCP) generation block, local oscillators, mixers, power detectors, a digital core, and location, heading, and motion (LOHMO) sensors, which are not shown in FIG. 2B. In one implementation, master chip 280 is configured to perform axial ratio and cross-polarization calibration of combined linearly polarized signals received from the antennas in each of the front end units (e.g., front end unit 205 in FIG. 2A), convert the calibrated linear polarized signals to left-handed circularly polarized (LHCP) and right-handed circularly polarized (RHCP) signals, down convert the circularly polarized signals from radio frequency (RF) signals to intermediate frequency (IF) signals, detect powers of the circularly polarized IF signals, perform digital signal processing, and provide phase shift signals to the RF front end chips in each of the front end units through control buses 210*a* through 210*n*.

It should be noted that details of the axial ratio and cross-polarization calibration block, the left-handed circularly polarized (LHCP)/right-handed circularly polarized (RHCP) generation block, the local oscillators, the mixers, the power detectors, the digital core, and the location, heading, and motion (LOHMO) sensors are discussed in a related application, U.S. patent Ser. No. 15/225,071, filed on Aug. 1, 2016, and a related application, U.S. patent Ser. No. 15/225,523, filed on Aug. 1, 2016. The disclosures of these related applications are hereby incorporated fully by reference into the present application.

As shown in FIG. 2B, master chip 280 is configured to provide parallel control buses 210*a* through 210*n* to corresponding segments of the antenna panel (e.g., segments 111, 113, 115 and 117 in FIG. 1B) to provide phase shift signals to the corresponding RF front end chips in each segment. As stated above, in one implementation, each control bus 210*a*, 210*b*, 210*c* through 210*n* is a ten-bit bus. In another implementation, a digital chip-to-chip communication protocol such as Serial Peripheral Interface (SPI), Joint Test Action Group (JTAG), Inter-integrated Circuit ($I^2C$), or etc. is used to control each segment of the antenna panel. In another implementation, each control bus 210*a*, 210*b*, 210*c* through 210*n* may carry as many bits as necessary to control the RF front end chips in each corresponding segment. By dividing an antenna panel into a plurality of segments, where each of the plurality of segments includes a group of antennas and a set of RF front end chips (each RF front end chip being coupled to some antennas in the group of antennas), and by driving in parallel a plurality of control buses each coupled to a respective one of the plurality of segments, where each control bus is coupled to a set of serially connected RF front end chips, implementations of the present application provide efficient routing of phase shift signals to multiple RF front end chips. Thus, various implementations of the present inventive concepts result in integration of thousands of antennas in a single antenna panel which in turn results in efficient phase shifting, improved refresh rate, and a fully electronic beamforming for receiving desired electromagnetic signals by the wireless receiver without use of any mechanical parts or mechanical adjustments.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

The invention claimed is:

1. A wireless receiver comprising:

an antenna panel being divided into a plurality of segments;

each said plurality of segments having a group of antennas;

each said plurality of segments having a set of radio frequency (RF) front end chips;

each RF front end chip in said set of RF front end chips being coupled to some of said group of antennas;

a master chip driving in parallel a plurality of control buses, each said control bus coupled to a respective one of said plurality of segments;

each RF front end chip in said set of RF front end chips being serially coupled to one-another by a respective one of said plurality of control buses in said respective one of said plurality of segments.

2. The wireless receiver of claim 1 wherein each said control bus provides at least one phase shift signal to at least one of said RF front end chips in said set of RF front end chips.

3. The wireless receiver of claim 1 wherein each said control bus provides at least one amplitude control signal to at least one of said RF front end chips in said set of RF front end chips.

4. The wireless receiver of claim 1 wherein each said control bus provides phase shift signals and amplitude control signals to each said RF front end chip in said set of RF front end chips.

5. The wireless receiver of claim 1 wherein at least one antenna of said group of antennas provides a horizontally-polarized signal and a vertically-polarized signal to at least one of said RF front end chips in said set of RF front end chips.

6. The wireless receiver of claim 1 wherein each antenna of said group of antennas provides a horizontally-polarized signal and a vertically-polarized signal to a corresponding one of said RF front end chips in said set of RF front end chips.

7. The wireless receiver of claim 1 wherein at least one antenna of said group of antennas provides a horizontally-polarized signal and a vertically-polarized signal to respective phase shifters in at least one of said RF front end chips in said set of RF front end chips.

8. The wireless receiver of claim 1 wherein each antenna of said group of antennas provides a horizontally-polarized signal and a vertically-polarized signal to respective phase shifters in a corresponding one of said RF front end chips in said set of RF front end chips.

9. The wireless receiver of claim 1 wherein each said control bus carries phase shift signals and amplitude control signals from said master chip to a respective set of RF front end chips in each said plurality of segments.

10. The wireless receiver of claim 1 wherein each said control bus carries at least one phase shift signal causing a phase shift in at least one linearly polarized signal received from at least one antenna of said group of antennas, and at least one amplitude control signal causing an amplitude change in said at least one linearly polarized signal.

11. The wireless receiver of claim 1 wherein said master chip and said plurality of segments in said antenna panel are integrated on a single printed circuit board.

12. The wireless receiver of claim 1 wherein said master chip, each said group of antennas, and each said set of RF front end chips are integrated on a single printed circuit board.

13. A wireless receiver comprising:

an antenna panel being divided into a plurality of segments;

each said plurality of segments having a group of antennas;

each said plurality of segments having a set of radio frequency (RF) front end chips;

each RF front end chip in said set of RF front end chips being coupled to some of said group of antennas;

a master chip driving in parallel a plurality of control buses, each said control bus coupled to a respective one of said plurality of segments;

each RF front end chip in said set of RF front end chips being serially coupled to one-another by a respective one of said plurality of control buses in said respective one of said plurality of segments;

each said control bus providing phase shift signals to respective phase shifters and amplitude control signals to respective variable gain amplifiers in each RF front end chip in said set of RF front end chips;

each said respective phase shifters receiving a linearly polarized signal from a respective antenna in said group of antennas.

14. The wireless receiver of claim 13 wherein said respective antenna provides a horizontally-polarized signal to a corresponding one of said respective phase shifters.

15. The wireless receiver of claim 13 wherein said respective antenna provides a vertically-polarized signal to a corresponding one of said respective phase shifters.

16. The wireless receiver of claim 13 wherein at least four antennas in said group of antennas are coupled to each RF front end chip in said set of RF front end chips.

17. The wireless receiver of claim 13 wherein at least one antenna of said group of antennas provides a horizontally-polarized signal and a vertically-polarized signal to one of said RF front end chips in said set of RF front end chips.

18. The wireless receiver of claim 13 wherein each antenna of said group of antennas provides a horizontally-polarized signal and a vertically-polarized signal to one of said RF front end chips in said set of RF front end chips.

19. The wireless receiver of claim 13 wherein at least one of said phase shift signals causes a phase shift in said linearly polarized signal received from said respective antenna in said group of antennas.

20. The wireless receiver of claim 13 wherein at least one of said amplitude control signals causes an amplitude change in said linearly polarized signal received from said respective antenna in said group of antennas.

21. The wireless receiver of claim 13 wherein said master chip, each said group of antennas, and each said set of RF front end chips are integrated on a single printed circuit board.

22. The wireless receiver of claim 13 wherein said master chip is configured to provide said phase shift signals and said amplitude control signals using at least one of Serial Peripheral Interface (SPI), Joint Test Action Group (JTAG), and Inter-integrated Circuit ($I^2C$) digital chip-to-chip communication protocols.

* * * * *